United States Patent [19]

Ostgaard

[11] 4,322,182

[45] Mar. 30, 1982

[54] APPARATUS AND METHOD FOR UNDER-WATER JACKING OF PILES

[76] Inventor: John T. Ostgaard, 7855 Vicksburg Ave., Los Angeles, Calif. 90045

[21] Appl. No.: 98,505

[22] Filed: Nov. 29, 1979

Related U.S. Application Data

[63] Continuation-in-part of Ser. No. 3,593, Jan. 15, 1979.

[51] Int. Cl.[3] ..... E02D 5/00

[52] U.S. Cl. ..... 405/227; 254/29 R; 405/184; 405/199

[58] Field of Search ..... 405/199, 224, 228, 184, 405/196, 197, 225, 227; 254/29 R, 105

[56] References Cited

U.S. PATENT DOCUMENTS

| | | | |
|---|---|---|---|
| 2,771,747 | 11/1956 | Rechtin | 405/199 |
| 2,946,557 | 7/1960 | Suderow | 405/197 X |
| 2,984,075 | 5/1961 | Suderow | 405/197 |
| 2,994,202 | 8/1961 | Knapp et al. | 405/224 |
| 3,008,691 | 11/1961 | Steele et al. | 405/198 X |
| 3,290,007 | 12/1966 | Yeilding | 405/198 X |
| 3,323,315 | 2/1966 | Levake | 405/170 |
| 3,396,945 | 8/1968 | Schreier et al. | 405/199 X |
| 3,411,750 | 11/1968 | Smulders | 405/198 X |
| 3,762,174 | 10/1973 | Fikse et al. | 405/184 |
| 3,895,471 | 7/1975 | Kolb | 405/227 X |
| 3,998,428 | 12/1976 | Miles | 254/29 R |
| 4,151,888 | 5/1979 | Jansz | 405/232 X |
| 4,159,819 | 7/1979 | Bargel et al. | 254/29 R |

*Primary Examiner*—Dennis L. Taylor

*Attorney, Agent, or Firm*—Fulwider, Patton, Rieber, Lee & Utecht

[57] ABSTRACT

Piles that anchor off-shore oil and gas well towers are driven into the ground by successive extensions of a hydraulic jacking cylinder. The cylinder is positioned under water, just above the pile, and secured to an adjacent column to prevent it from moving upwardly. Preferably, the column is formed by a casing releasably latched to a selected pile-receiving guide at the bottom of the tower, the pile extending upwardly into the casing.

10 Claims, 12 Drawing Figures

118
116
135
102
104
120c
120b
120a
114
113
100
112a
5
110
106
108
112b
112
132
134
122
138
124
130
126
128
140
136
142
5a 164
6a
154
144
146
152
120
6b
150
176
6c
166
168

162
158
154
146
156
120

146
180
176
178
120
182

174
172
166
168
170
114
120

164
144
146
148
152
150
120
114

APPARATUS AND METHOD FOR UNDER-WATER JACKING OF PILES

RELATED APPLICATIONS

This is a continuation-in-part of the inventor's application Ser. No. 3,593 entitled APPARATUS AND METHOD FOR DRIVING MEMBERS INTO THE OCEAN FLOOR, filed Jan. 15, 1979.

FIELD OF THE INVENTION

The present invention relates to towers for off-shore oil and gas wells, and, more particularly, to methods and apparatus for driving piles to anchor such towers.

BACKGROUND OF THE INVENTION

It is often desired to drive piles into the ocean floor to depths of several hundred feet or more to anchor a tower or platform structure from which oil and gas wells can be drilled and operated. An exemplary oil or gas well tower of a type used in water of medium depth, typically about 400 to 500 feet, is described in U.S. Ser. No. 3,895,471. It is anchored by a circular array of piles, one at each of four corners. The tower is wider at its base than at the top and each pile is driven at an angle to the vertical that is approximately aligned with an imaginary line connecting outer edges of the tower at the top and at the bottom. Although it is more difficult to drive the piles at such an angle, it is thought that greater holding power results. It should be noted that the piles do not extend to the top of the tower but terminate at the top of relatively short pile-receiving guides that form part of the base structure of the tower.

A tower of this general construction is said to be "nailed" to the ocean floor and is not to be confused with the guyed tower type of construction in which the piles extend to a point above the ocean floor and form an integral part of the entire tower structure. As a rule, guyed towers are suitable for use in greater water depths, such as one thousand feet.

The present state of the art calls for pounding the piles by the repeated blows of a hammer. Each blow may contain more than one million foot pounds of energy, but at deep penetration drives the member only a fraction of a foot.

Conventionally, a hammer and its leads, which may weigh 400 tons or more, must be supported above a pile by a crane mounted on a barge. The further into the ocean floor a pile is driven, the greater the force required to drive it and the larger the hammer must be. Some experts believe that a large portion of the hammer energy is absorbed by radial movement and vibration of the pile throughout is length. In the case of a "nailed" tower, additional energy is absorbed by a long follower that transmits the force from the above-water hammer to the top of the pile. The use of a hammer is greatly complicated by the movement of the barge and crane relative to the pile due to wind and water currents. Limited use has been made of underwater hammers.

Many areas in which towers are located frequently experience severe storms. It is, therefore, necessary to wait for a suitable "weather window" during which to erect the tower and drive the piles. As the time required to drive the piles increases, the necessary window becomes larger. The difficulty of finding such a window increases as does the chance of an unexpected storm that could prove disasterous. It is, therefore, important to drive the piles as rapidly as possible so that the structure can withstand heavy seas if necessary. It is also highly desirable to have an effective technique for anchoring the tower to any partially driven piles in the event of an unexpected storm.

There are important disadvantages associated with conventional hammer-driven piles that relate to their essential purpose of securing the tower. When the pile is hammered, it unavoidably moves radially as it abruptly surges downwardly with each blow. In so doing, it disturbs the soil around it, and may leave an annular space between the pile and the soil which reduces soil friction. Although the soil may regain part of this initial strength as it settles, some loss is permanent. The result is that the forces and energy required to remove the pile are less than that required to drive it and the holding power of the pile is not accurately predictable, even if the energy used in driving it is known.

Another problem experienced with hammer-driven piles is that the numerous variables make it difficult or impossible to accurately monitor the force required to drive the pile at successive penetration levels. For this reason, existing techniques that attempt to predict the static-bearing capacity of a pile based on the history of its dynamic drive resistance are not totally reliable. To compensate for this unreliability, large safety factors must be included in design specifications. In some situations, a pile is driven at considerable cost to a predetermined depth far greater than that required to secure the tower when soil conditions offer more resistance than expected.

Objectives of the present invention are to provide new methods and apparatus for driving piles that secure oil and gas well towers and similar structures. A further objective is to utilize apparatus that is of less weight, has lower energy requirements, and is more easily managed. Other objectives are to drive the pile in a manner that minimizes the disturbance of the soil surrounding it and renders the holding power of the pile more predictable.

SUMMARY OF THE INVENTION

According to the method of the present invention, members, such as piles for off-shore oil and gas well towers, are driven into the ocean floor by the expansion of under-water jacking cylinders. Radial movement or vibration of the members is substantially eliminated so that the disturbance of the soil is minimized and the maximum adhesive strength of the soil is retained. Since the maximum instantaneous load on the member is reduced, the wall thickness can be reduced correspondingly. The force applied to the members can be accurately monitored so that their static-bearing capacity can be estimated with greater accuracy.

More specifically, the method of the invention involves positioning a column at a location where a member is to be driven. The column may be a temporary structure used only for pile driving or it may be a permanent, integral part of the tower itself. The member is then positioned so that it extends along the column. A cylinder is secured to the column, thereby preventing upward movement of the cylinder, and a piston is displaced downwardly within the cylinder to jack the member into the ocean floor. The piston can then be retracted, the cylinder moved down and resecured to the column, and the operation is repeated to drive the member further.

According to an exemplary form of the invention, the column is in the form of a cylindrical casing that receives the jacking cylinder and the pile internally. It can be made up of a series of casing sections releasably connected end-to-end.

The invention is particularly advantageous in anchoring oil and gas well towers. The base end of the tower may include an array of pile-receiving guides. The casing is selectively attached to a selected one of the guides to form an upward extension thereof. After that pile has been driven, the casing is moved to another guide and the pile driving operation is repeated. The casing and cylinder can also be secured to the pile to prevent upward movement of the casing. In this manner, the casing and associated structure can be held in place by a partially driven pile during a storm, if necessary.

Another aspect of the invention that relates to an apparatus for driving piles includes a tower to be positioned on the ocean floor, the tower having a pile-receiving guide at its bottom end. A column, preferably a casing, forms an upward extension of the guide. To drive the pile downwardly into the ocean floor, a pile jacking means includes a cylinder and a piston reciprocable within the cylinder. The cylinder is secured to the casing to prevent upward movement when the piston is extended hydraulically.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figures 1, 1A, 2, 3, 4, 5, 5A:
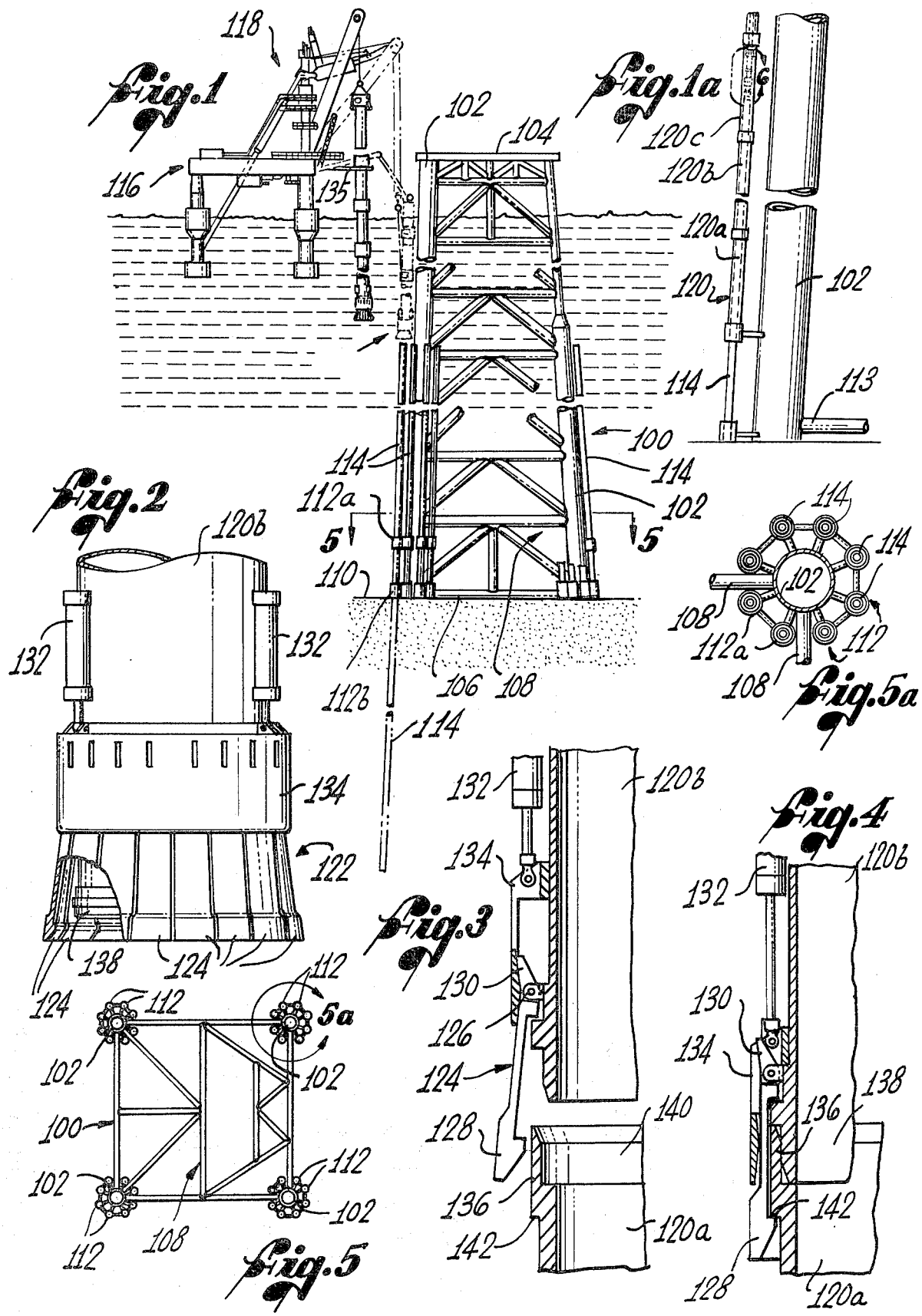
FIG. 1 is a pictorial side elevation of a gas and oil well tower ready to be anchored to the ocean floor in accordance with the present invention, portions of the tower being broken away to reduce its height in the drawing and some piles on the left side being broken away to expose a leg.
FIG. 1*a* is also a side elevation showing an assembled casing in position over a pile, the rest of the piles being omitted and the position of the jacking cylinder being indicated in phantom lines.
FIG. 2 is an enlarged, fragmentary side view of the lower end of a casing section, taken as indicated by the arrow 2 in FIG. 1, a portion of the latch mechanism at the bottom being partially broken away.
FIG. 3 is a fragmentary, cross-sectional, side view of two successive casing sections about to be engaged.
FIG. 4 is another fragmentary, cross-sectional, side view, similar to FIG. 3, showing the same two casing sections after they have been engaged and latched together.
FIG. 5 is a cross-sectional view, taken along the line 5—5 of FIG. 1, looking downwardly at the base of the tower.
FIG. 5*a* is an enlargement of a fragmentary portion of FIG. 5 encircled by the arrow of 5*a;*

The present invention will be explained in greater detail with reference to the construction of an off-shore oil or gas well tower 100, shown in FIG. 1. It will be understood, however, that the invention has wide application and the reference to this particular structure 100 is merely exemplary.

The tower 100 is of a type often used in water of medium depth, about 500 feet. It is generally square in horizontal cross section, having four legs 102, one at each corner, that are generally vertical but slightly inclined for attachment to a top structure 104 that is smaller than the base 106. A lattice work of braces 108 connects the legs 102 to strengthen and rigidify the tower 100. When properly positioned, the base 106 of the tower 100 rests on the ocean floor 110 with the top structure 104, where a deck can be constructed later, safely above the high water mark.

At the base 106, each leg 102 is surrounded by a circular array of pile receiving guides 112. The guides 112 are firmly secured to the legs 102 to form a skirt. Each guide is formed by a pair of axially aligned collars, an upper collar 112*a* and a lower collar 112*b*. The collars 112*a* and 112*b* are connected to the legs 102 by radial struts 113, as shown in FIG. 5*a*.

It is desired to "nail" the tower 100 to the ocean floor 110 with a plurality of piles 114 each of which is to be driven downwardly through one of the guides 112. Typically, at a 500 foot water depth, an individual pile 114 might be about 240 feet long, having an outside diameter of 48 to 96 inches and a wall thickness of 1.0 to 2.5 inches. It would be driven to a depth of about 200 feet, the optimum depth at a particular well site being a function of local conditions. These dimensions given here are merely for purposes of explaining a particular example and are not in any way intended to be a limitation on the scope of the invention.

When the tower 100 is initially transported to the well site, a pile 114 has already been installed in each of the guides 112 and attached to the upper portion of the adjacent leg 102 by attachment devices secured by explosive bolts or other removable connectors (not shown). A barge 116 that carries a crane 118 is positioned along side the tower 100 and a casing 120 for use in driving the piles 114 is assembled. In this exemplary arrangement, the casing 120 is formed of five similar casing sections to be assembled end-to-end. The first section 120*a* is held vertically by tongs 121 on the edge of the top structure 104 of the tower 100 so that it extends downwardly into the water which the crane 119 positions the next section 120*b* above it.

The bottom end of the second casing section 120*b* engages the first section 120*a*. At the bottom end of the second section 120*b* is a latch mechanism 122 by which that section is attached to the section 120*a* below. Each latch mechanism 122, includes a plurality of axially extending latch segments 124 arranged side-by-side about the outer surface of the bottom end of the section 120*b* as shown in FIG. 2. The clamp segments 124 can rock on pivot pins 126 carried by the casing section 120*b*. Below the pivot pins 126, the segment 124 form hooks 128 while above the pivot pins they form tails 130 that are angled outwardly away from the casing 120. Above the pivot pins 126 is a group of small hydraulic cylinders 132 that can be actuated to cause a slider ring 134 to move axially along the section 120*a*. When the cylinders 132 is in its retracted positions, the slider ring 134 pushes the tails 130 inwardly, thereby causing the hooks 128 to move radially outwardly. With the hooks 128 in this position, they can move past an annular upper portion 136 of the upper guide collar 112*a* that is of increasd diameter, as shown in FIG. 3.

Once the second section 120*b* engages the first section 120*a*, the end 138 of the second section being received within an annular release 140 formed by a level at the top of the first section 120*a*, the hooks 128 have moved past the upper portion 136. The cylinders 132 are then extended, causing the slider ring 134 to push the hooks 128 radially inwardly so that they engage a flange 142 on the underside of the upper portion 136. In this way, the second casing section 120*b* is firmly but releasably latched to the first.

After the first and second sections 120*a* and 120*b* have been connected, they are jointly lowered until the top of the second section is about level with the top of the tower 100 and the two sections are again held by the tongs 121 while another section is added. This process is repeated until the entire casing 120 has been assembled.

The casing 120 is then lifted by the crane 118, using a sling 135, and positioned over a selected pile-receiving guide 112, as shown in FIG. 1*a*. The sling 135 is rigged to hold the casing 120 at a proper angle matching that of the pile 114. The bottom of the first casing section 120*a* is then latched to the upper collar 112*a* of the guide 112 in the same manner that the casing sections are connected to each other.

Figures 6, 6A, 6B, 6C, 7:
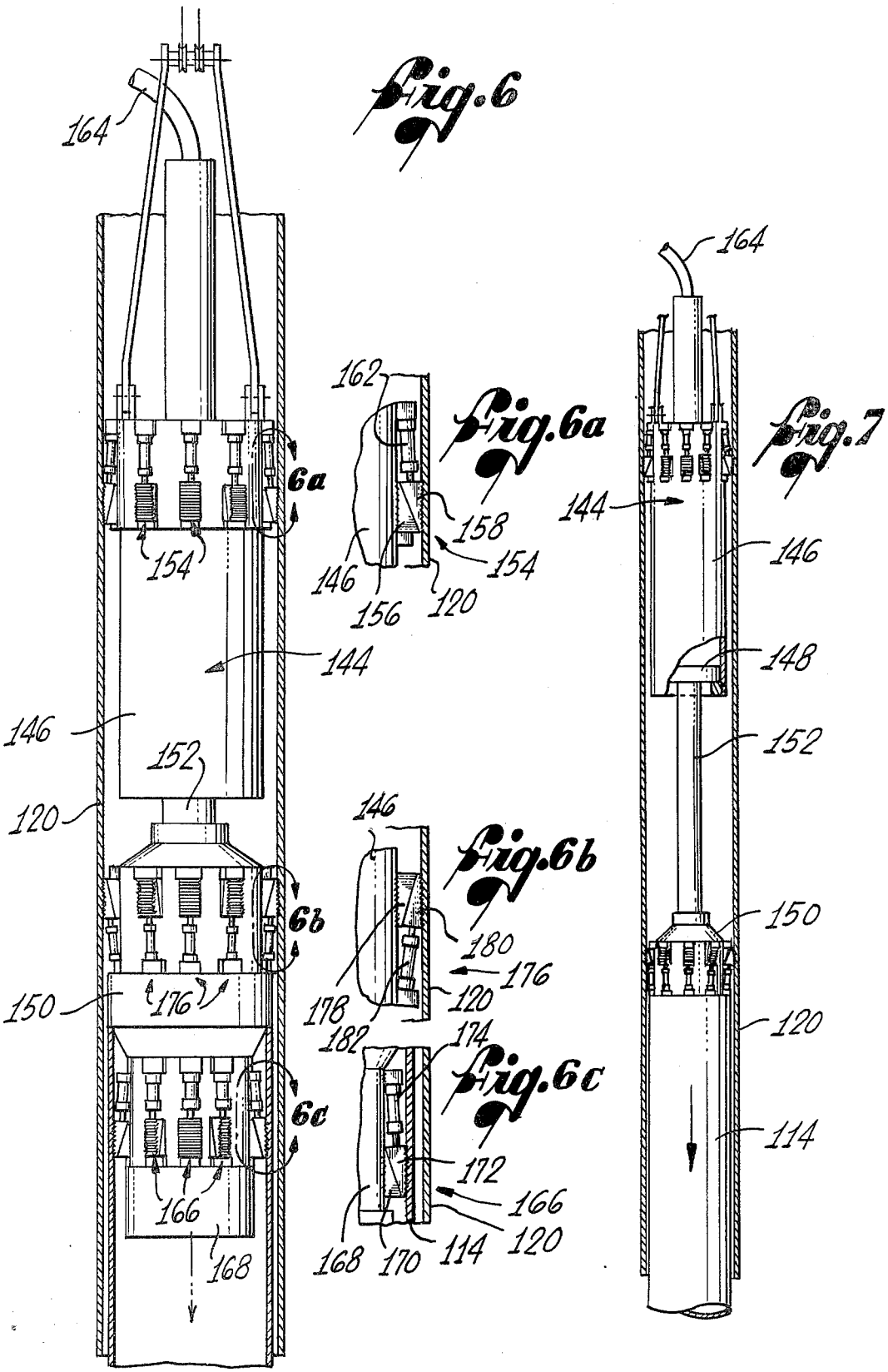
FIG. 6 is an enlarged, fragmentary, cross-sectional view of a portion of casing section and pile indicated by the arrow G of FIG. 1*a,* also showing the jacking cylinder positioned above the pile with its piston retracted.
FIGS. 6*a,* 6*b* and 6*c* are enlargements of fragmentary portions of FIG. 6 indicated by the arrows 6*a,* 6*b* and 6*c,* respectively.
FIG. 7 is another cross-sectional view, similar to FIG. 6 but on a reduced scale, showing the cylinder and piston in an extended position, a lower corner of the cylinder being broken away to expose the piston.

Once the casing 120 is in position, the crane 118 is used to lower a hydraulic jacking mechanism 144 into position within the casing, as shown in FIGS. 1*a* and 6. This mechanism 144 includes a hydraulic cylinder 146 in which a piston 148 is reciprocable vertically. A ram 150 is connected to the bottom of the piston 148 by a rod 152. With the piston 148 in its retracted position, as shown in FIG. 6, the ram 150 is placed in engagement with the top end of the pile 114. A group of slip mechanisms 154, as shown in greater detail in FIG. 6*a*, are then actuated to secure the cylinder 146 to the inside surface of the casing 120 in such a manner that upward movement of the cylinder within the casing is prevented.

The slip mechanisms 154 are arranged circumferentially about the top of the cylinder 146. Each consists of a ramp 156 that is immovably attached to the outside of the cylinder 146 and slopes inwardly toward the top of the cylinder. A wedge 158 slides on the ramp 156 with its narrow end pointing downwardly. The outer surface of the wedge 158, which opposes the inner surface of the casing 120, carries a series of teeth 160 that extend across it horizontally, the teeth being shaped and oriented so that they resist upward motion of the cylinder 146.

Each wedge 158 is connected to a small double acting slip cylinder 162 that causes it to move along the ramp 156, in and out of contact with the casing 120, when actuated. When the slip cylinder 162 is extended, it pushes the wedge 158 downwardly along the ramp 156 until the wedge engages the inside of the casing 120. When actuated in this manner, the slip mechanism 154 can hold the cylinder 144 stationary within the casing 120 despite large upwardly directed forces.

Once the slip mechanisms 154 have been actuated as explained above, the piston 148 is caused to move downwardly within the cylinder 146 by the admission of hydraulic fluid to the cylinder through a line 164 that leads to a power station (not shown) on the barge 116. Since the cylinder 146 cannot move upwardly, the downward movement of the piston 148 and the ram 150 forces the pile 114 to move downwardly, penetrating the ocean floor. An exemplary cylinder 146 might apply 3000 psi of pressure to the piston 148 to produce a force of 5000 tons over a stroke of 10 feet.

After the cylinder 146 is fully extended and the piston 148 has reached the limit of its downward travel, the piston is retracted while lowering the cylinder to keep the ram 150 in contact with the top of pile 114. The slip mechanisms 154 are reactivated and the piston 148 is again extended. This sequence of steps is repeated, with the cylinder 146 chasing the pile 114 down through the casing 120 until the top of the pile is approximately even with the top of the guide 112 in which it is received. The pile 114 is then ready to be welded to its guide 112 to permanently anchor the tower 100. If desired, duplicate sets of pile jacking equipment can be provided to drive diagonally opposite piles 114 simultaneously, thereby stabilizing the tower 100. Note that during the driving operation the casing 120 serves not only to absorb the reaction force of the cylinder 146 but also to guide the cylinder and to position the pile 114, making it easier to drive the pile at the desired angle.

Each pile 114 is driven in succession in this manner. If there is a sufficient vertical distance between the tops of the undriven piles 114 and the top of the crane 118, it is possible to move the casing 120 from one pile to the next without disassembling the casing sections. An exception must be made, however, in the case of two piles 114*a* that are located inside the lattice work 108 of the tower 100. For these piles 114*a*, it is necessary to disassemble the casing 120 and then reassemble it, again using the tongs 135, on the inside of the tower top structure 104.

Since a large number of piles 114 must be driven before the task of permanently anchoring the tower 100 has been completed, there is a possibility of unexpected weather conditions interrupting the operation. It is, therefore, desirable to be able to temporarily connect the casing 120 to any pile 114 that is in the process of being driven to prevent upward movement of the tower 100. This is accomplished by a second set of slip mechanisms 166, shown in greater detail in FIG. 6*c*, that connect the ram 150 to the inter-surface of the pile 114. These slip mechanisms 166 are carried on a projection 168 that extends downwardly into the center of the pile 114. Each slip mechanism 166 includes a ramp 170 that is mounted on the projection 168 and is tapered inwardly toward its top end. A wedge 172 that slides on the ramp 170 is movable in response to the actuation of a small hydraulic cylinder 174. The operation of the second set of slip mechanisms 166 is similar to that of the first set 156.

A third set of slip mechanisms 176 is arranged near the top of the ram 150, between the ram and the inner surface of the casing 120. Each of these mechanisms 176 includes a ramp 178, a wedge 180 and a hydraulic cylinder 182.

The slip mechanisms 176 of the third set are also similar to those mechanisms 154 of the first set except that they are inverted so as to prevent upward movement of the ram 150 relative to the casing 120. Thus, when the second and third sets of slip mechanisms 166 and 176 are actuated, any tendency of the tower 100 to move upwardly will pull upwardly on the ram 150, which will in turn pull upwardly on the pile 114.

It will be noted that the force required to drive each pile 114 can be readily graphed, with precision, against the penetration of the pile. This information gives an accurate indication of the bearing capacity of the pile 114, which can be computed continuously as the pile is driven. One important advantage of these calculations is that they permit an on-site determination of the depth to which each individual pile 114 must be driven to obtain the bearing capacity required. The waste inherent in driving piles to predetermined depths, assumed to be necessary on the basis of test bores, is eliminated.

Piles driven according to the present invention can have substantially greater bearing capacity than piles driven to the same depth using hammers because the soil is not disturbed by substantial radial movement and vibrations of the piles. The adhesion of the soil to the pile remains at a maximum. The piles can be lighter because the maximum instantaneous load is much lower than that reached when a hammer is used. In the past, piles have often been heavier than otherwise required simply to withstand the impact of the hammer.

An another important advantage of the present invention is that the driving equipment is much smaller and simpler and requires less energy input. Since the equipment for driving the pile is lighter, a smaller crane can be used.

While a particular form of the invention has been illustrated and described, it will also be apparent that various modifications can be made without departing from the spirit and scope of the invention.

I claim:

1. A method for driving piles for an off-shore oil or gas tower comprising the steps of:

(a) positioning said tower on the ocean floor, said tower having a plurality of pile receiving guides extending upwardly from the ocean floor;

(b) lowering a casing over a selected pile and aligning it with a selected one of said guides;

(c) clamping said casing to said selected guide to form an upward extension of said guide;

(d) lowering a jacking cylinder into said casing and positioning said jacking cylinder under water and above said pile, said cylinder having a reciprocal piston therein;

(e) securing said cylinder to said casing to prevent upward movement of said cylinder;

(f) hydraulically causing said piston to move downwardly within said cylinder, thereby jacking said pile downwardly;

(g) retracting said piston within said cylinder;

(h) releasing said cylinder from said casing;

(i) lowering said cylinder;

(j) again causing said piston to move downwardly with said cylinder, thereby further jacking said pile downwardly;

(k) repeating steps f through j until said pile has been driven to a desired depth;

(l) withdrawing said cylinder from said casing;

(m) releasing said casing from said selected guide;

(n) positioning said casing in alignment with another one of said guides; and (o) repeating steps c through k.

2. A method for driving piles to anchor an off-shore oil or gas well tower comprising the steps of:

(a) positioning said tower on the ocean floor, said tower having a plurality of legs each with an associated circular array of pile-receiving guides and each extending upwardly from the ocean floor and terminating substantially above the water surface;

(b) positioning a barge with a crane thereon adjacent to said tower;

(c) assembling a plurality of casing sections end-to-end to form a continuous cylindrical casing;

(d) latching said casing to a selected one of said guides to form an upward extension of said selected guide;

(e) lowering a jacking cylinder by said crane into said casing and positioning said jacking cylinder under water and above said pile, said cylinder having a reciprocable piston therein;

(f) securing said cylinder to the inside of said casing to prevent upward movement thereof;

(g) hydraulically causing said piston to move downwardly with in said cylinder, thereby jacking said pile downwardly;

(h) retracting said piston within said cylinder;

(i) releasing said cylinder from said casing;

(j) lowering said cylinder by said crane;

(k) again securing said cylinder to the inside of said casing to prevent upward movement thereof;

(l) again causing said piston to move downwardly within said cylinder, thereby further jacking said pile downwardly;

(m) repeating steps h through l until said pile has been driven to a desired depth;

(n) withdrawing said cylinder from said casing by said crane;

(o) releasing said casing from said selected guide;

(p) using said crane to position said casing in alignment with another one of said guides; and (q) repeating steps d through o.

3. A tower and associated apparatus for constructing an off-shore oil or gas well comprising;

a tower to be positioned on the ocean floor, said tower having a plurality of legs and an array of upstanding pile-receiving guides surrounding each of said legs;

a cylindrical casing to form an upward extension of a selected one of said guides, said casing comprising a plurality of casing sections and means for releasably latching said sections together end-to-end;

means for selectively latching said casing to said guides;

hydraulic jacking means including a cylinder and a piston reciprocal therein for jacking a pile downward into the ocean floor;

means for securing said pile jacking means to said casing to prevent upward movement thereof under the force of said pile jacking means; and means for further securing said pile jacking means to said casing to prevent upward movement of said casing and said tower relative to said pile.

4. A method for driving piles for an off-shore oil or gas tower comprising the steps of:

(a) positioning said tower on the ocean floor, said tower having a plurality of pile-receiving guides at the bottom end thereof;

(b) lowering a column and aligning it with a selected one of said guides;

(c) securing said column to said selected guide to form an upward extension thereof;

(d) positioning a jacking cylinder and piston combination under water and above a pile received by said selected guide;

(e) securing said cylinder and piston combination to said column to prevent upward movement thereof;
(f) hydraulically causing said piston to move relative to said cylinder and thereby jacking said pile downwardly;
(g) retracting said piston within said cylinder;
(h) releasing said cylinder and piston combination from said column;
(i) lowering said cylinder and piston combination;
(j) again causing said piston to move relative to said cylinder and thereby further jacking said pile downwardly;
(k) repeating steps f through j until said pile has been driven to a desired depth;
(l) releasing said column from said selected guide;
(m) positioning said column in alignment with another one of said guides; and
(n) repeating steps c through k.

5. The method of claim 4 comprising the further steps of securing said cylinder and piston combination to said pile to prevent upward movement of said column and said tower relative to said pile.

6. A method for driving piles to anchor an off-shore oil or gas well tower comprising the steps of:
(a) positioning said tower on the ocean floor so that it terminates above the water surface, said tower having a plurality of legs, each leg being associated at the bottom end thereof with an array of pile-receiving guides;
(b) assembling a plurality of column sections end-to-end to form a continuous column;
(c) securing said column to a selected one of said guides to form an upward extension of said selected guide;
(d) lowering a jacking cylinder and piston combination along said column and thus positioning said jacking cylinder and piston combination under water and above a pile received by said selected guide;
(e) securing said cylinder and piston combination to said column to prevent upward movement thereof;
(f) hydraulically expanding said cylinder and piston combination and thereby jacking said pile downwardly;
(g) contracting said cylinder and piston combination;
(h) releasing said cylinder and piston combination from said column;
(i) lowering said cylinder and piston combination;
(j) again securing said cylinder and piston combination to said column to prevent upward movement thereof;
(k) hydraulically expanding said cylinder and piston combination and thereby further jacking said pile downwardly;
(l) repeating steps g through k until said pile has been driven to a desired depth;
(m) releasing said column from said selected guide;
(n) positioning said column in alignment with another one of said guides; and
(o) repeating steps c through o.

7. The apparatus of claim 3 further comprising means for securing said pile jacking means to said pile to prevent upward movement of said casing and said tower relative to said pile.

8. A tower and associated apparatus for constructing an off-shore oil or gas well comprising:
a tower to be positioned on the ocean floor, said tower having a plurality of legs and an array of pile-receiving guides surrounding each of said legs;
a column to form an upward extension of a selected one of said guides;
means for selectively latching said column to said guides;
hydraulic jacking means including a cylinder and a piston reciprocal therein for jacking a pile downward into the ocean floor; and
slip means for frictionally securing said pile jacking means to said column at selected non-discrete locations to prevent upward movement of said pile jacking means.

9. The apparatus of claim 8 further comprising:
means for securing said pile jacking means to said column to prevent upward movement of said column and said tower relative to said pile; and
means for securing said pile jacking means to said pile to prevent upward movement of said casing and said pile relative to said pile.

10. The apparatus of claim 9 wherein said column comprises a plurality of sections and means for releasably latching said sections together end-to-end.

* * * * *

UNITED STATES PATENT AND TRADEMARK OFFICE

CERTIFICATE OF CORRECTION

PATENT NO. : 4,322,182

DATED : March 30, 1982

INVENTOR(S) : John T. Ostgaard

It is certified that error appears in the above-identified patent and that said Letters Patent is hereby corrected as shown below:

The term of this patent subsequent to November 9, 1999 has been disclaimed.

Signed and Sealed this

*Sixth* Day of *September 1983*

[SEAL]

*Attest:*

GERALD J. MOSSINGHOFF

*Attesting Officer*

*Commissioner of Patents and Trademarks*